US007079454B2

(12) United States Patent
Wellen

(10) Patent No.: US 7,079,454 B2
(45) Date of Patent: Jul. 18, 2006

(54) TACTILE TIMEPIECE

(76) Inventor: Alexander Wellen, 8 Bernice St., Suite 201, San Francisco, CA (US) 94103

( * ) Notice: Subject to any disclaimer, the term of this patent is extended or adjusted under 35 U.S.C. 154(b) by 335 days.

(21) Appl. No.: 10/743,524

(22) Filed: Dec. 23, 2003

(65) Prior Publication Data

US 2005/0135198 A1 Jun. 23, 2005

(51) Int. Cl.
*G04B 25/02* (2006.01)

(52) U.S. Cl. ..... 368/230; 368/223

(58) Field of Classification Search ..... 368/230, 368/76–77, 223; 968/245
See application file for complete search history.

(56) References Cited

U.S. PATENT DOCUMENTS

| | | | | |
|---|---|---|---|---|
| 360,641 A | | 4/1887 | Adam | |
| 365,032 A | | 6/1887 | Von Wechmar | |
| 856,608 A | | 6/1907 | Seeler | |
| 1,222,369 A | | 4/1917 | Duncan | |
| 2,091,146 A | | 8/1937 | Hamilton | 58/127 |
| 2,168,314 A | | 8/1939 | Blanks | 58/126 |
| 2,177,234 A | * | 10/1939 | Walser | 368/77 |
| 2,915,874 A | | 12/1959 | Ferguson, Jr. | 58/126 |
| 3,250,023 A | | 5/1966 | Benson | 35/35 |
| 3,438,195 A | | 4/1969 | Cochin | 58/1 |
| 3,646,653 A | | 3/1972 | Richard | 29/177 |
| 3,648,647 A | | 3/1972 | Joy | 116/114 |
| 3,740,446 A | | 6/1973 | Benson | 35/35 |
| 3,938,317 A | | 2/1976 | Spano | 58/23 |
| 4,185,283 A | | 1/1980 | Clark | 340/802 |
| 4,582,251 A | | 4/1986 | Odom, Jr. et al. | 236/94 |
| 5,311,487 A | | 5/1994 | Mininni et al. | 368/230 |
| 5,365,497 A | | 11/1994 | Born | 368/230 |
| 5,559,761 A | | 9/1996 | Frenkel et al. | 368/69 |
| 5,580,251 A | | 12/1996 | Gilkes et al. | 434/113 |
| 5,719,561 A | | 2/1998 | Gonzales | 340/825.46 |
| 5,775,252 A | | 7/1998 | Kilgore | 116/205 |
| 6,052,339 A | | 4/2000 | Frenkel et al. | 368/230 |
| 6,109,922 A | | 8/2000 | Litschel et al. | 434/114 |
| 6,218,958 B1 | | 4/2001 | Eichstaedt et al. | 340/825.46 |
| 6,359,550 B1 | | 3/2002 | Brisebois et al. | 340/407.1 |
| 6,445,284 B1 | | 9/2002 | Cruz-Hernandez et al. | 340/407.1 |

OTHER PUBLICATIONS

"Asulab—Watches", from Asulab website, ©Asulab, 2001-2003.

* cited by examiner

*Primary Examiner*—David M. Gray
*Assistant Examiner*—Sean Kayes
(74) *Attorney, Agent, or Firm*—Winston & Strawn LLP

(57) ABSTRACT

A tactilely readable timepiece with a clock device that keeps time. The display comprises a display area and at least one moveable portion within the display. The moveable portion is moveable with respect to the display to form at least one displayed character that is recognizable by touch by a user and has a tactilely sensible shape that is independent of a system of dots. An actuator operably associates the clock device of the moveable portion for displacing and positioning the moveable portion to form the displayed character depending on the current time kept by the clock device.

27 Claims, 8 Drawing Sheets

TACTILE TIMEPIECE

FIELD OF THE INVENTION

The invention relates to a timepiece that can be read tactilely, and more particularly to a timepiece that can be tactilely read with little or no learning of a complex new tactile code.

BACKGROUND OF THE INVENTION

Wrist and pocket watches have been developed that are readable by touch alone for the visually impaired or in the dark. U.S. Pat. No. 365,032, for example, discloses a watch with revolving hands that have protuberances for reading time in the dark. The hour hand has one protuberance, and the minute hand has two protuberances to distinguish one hand from the other. Studs or raised points are disposed to be felt at the same time as the hands to provided as guides or position marks. Also, U.S. Pat. No. 360,641 teaches a watch for the blind with hands with projections that can be felt through annular slots between plates to tell the time, with hour and five-minute marks being provided by ribs on the outer surfaces of the plates.

U.S. Pat. Nos. 1,222,369 and 2,168,314 disclose watches that can be read by touch. These watches have analog revolving discs with hour and minute indicators or hands that revolve to tell the time and can be felt by touch. Fixed touch-readable projections are provided about the revolving indicators to designate the position of the hours about the face of the watch.

Other developments include watches that deliver time information by employing a silent vibration device, such as disclosed in U.S. Pat. Nos. 5,559,761 and 6,052,339. U.S. Pat. No. 5,311,487 teaches a wristwatch with two square-areas, each with four cursors that come out or back into the case to form codified combinations that can be interpreted by touch. Although not in the field of wristwatches, U.S. Pat. No. 2,091,146 discloses a clock with a disk that makes a complete rotation every twenty-four hours and on which raised dots are provided as Braille numerals. A window is provided to permit a finger to engage the Braille.

A timepiece is needed that can provide a sighted person a readily interpretable tactile display of the time, preferably without requiring that the user learn a complex code.

SUMMARY OF THE INVENTION

The present invention relates to a tactilely readable timepiece that can be easily read tactiley by a person who has good vision, preferably without learning any substantial code system. The preferred embodiment has a clock device that is configured for keeping time, and a display configured for displaying the kept time. The display preferably includes a display area and at least one moveable portion within the display area. The moveable portion is moveable with respect to another portion of the display area to form at least one displayed character. The displayed character is recognizable by touch by a user's finger. An actuator operably associates the clock device with the moveable portion for displacing and positioning the moveable portion to form a displayed character depending on the current time kept by the clock device. One preferred timepiece is a wristwatch that additionally includes a band configured for mounting the timepiece to a user's wrist.

The preferred displayed character has a tactilely sensible shape which is independent of an interpretation system based on dots. For example, the shape is not a Braille character nor the shape of several dots that need to be added together or that form a certain dot-dash arrangement that would need to be interpreted to obtain what number it represents.

The preferred displayed character is geometrical or belongings to a traditionally sight-based alpha-numeric system. The different characters can comprise Arabic numbers, Latin letters, or other letters and numbers from a visual writing or numerical system. The different characters can also comprise geometric shapes that are distinguishable by finger touch, and the preferred geometrical shapes have less than eight sides to facilitate interpretation by an unskilled user.

The displayed character can comprise one of a group of different characters representing preselected times kept by the clock device, and one embodiment of the displayed character can be configured to be identified by the user based on its orientation and discrete position in the display area. The preferred characters to be used, however, are configured to be identified by their shape, preferably regardless of their position or orientation. Preferably at least two different characters, and most preferably at least five different characters. To facilitate interpretation by an untrained user, the shape is preferably sufficiently large to be readily determined by touch and identified as a recognizable and preferably familiar character by the normally-sighted user.

In a preferred embodiment, the moveable portions comprise elongated segments that are arranged to form the displayed character. The shape of the moveable portions can otherwise be circles, triangles, or other shapes that are readily employable together to cooperatively form the desired displayed character. At least some or all of the characters can be displayed on substantially the same location in the display area. The displayed characters can all comprise a single digit or shape, or alternatively multiple digits or shapes.

Also, in the preferred embodiment a plurality of moveable portions are provided, and an actuator is configured to cooperatively position the moveable portions for creating the displayed character the shape of which is produced cooperatively by the moveable portions that are activated. The preferred actuator is configured for changing the elevation of the moveable portions with respect to a portion of the display area to form the displayed character. The actuator can elevate the moveable portions above the remainder of the display area, including unactivated moveable portions to form the display character, or alternatively can depress the moveable portion below the remainder of the display area, for instance.

In one embodiment, the moveable portions are generally pie-shaped and arranged generally around a central point on the display such that the height of at least one of the moveable portions is changed with respect to the others to indicate the general analogue clock position corresponding to the time kept on the clock device. Each moveable portion in this embodiment can be at a fixed lateral location in the face of the watch, but change elevates between at least two elevation positions.

The characters can represent at least each of the hours in a 12- or 24-hour period. In one embodiment, up to ten different characters are used, and a separate indicator can be used to indicate separately or in combination with the displayed character the remaining hours or other time periods kept in the clock. Another displayed character can also be used to represent different fractions of an hour. At least two, most, and possibly all of the moveable portions that form at least one of the different characters are sufficiently close together that any spacing therebetween is substantially undetectable by touch with a human finger-pad or at least easily distinguishable for other protrusions not associated with the character. In a preferred embodiment, the moveable portions are arranged as an at least seven-segment display, such as a typical digital display found on a digital wristwatch, but as indicated above, operating to be read tactilely instead of by sight.

The timepiece can also include an indicator portion that is movable by an actuator between at least two tactilely sensible positions to indicate the time capsule and the clock device in combination with the displayed character. The indicator can comprise a plurality of indicators, each with a position that in conjunction with the displayed character indicates the current time that is kept on the clock device. The plurality of indicators can be disposed around the display area in one embodiment, and in another embodiment an indicator is moveable by an actuator along a path to more precisely indicate the time kept on the clock device in combination with the displayed character.

The invention provides a timepiece that can easily be accessed and used, preferably without substantial training, either in a no-light condition or in situations where the user would prefer that no one notice that he or she is checking the time.

DETAILED DESCRIPTION OF THE PREFERRED EMBODIMENTS

Figure 2:
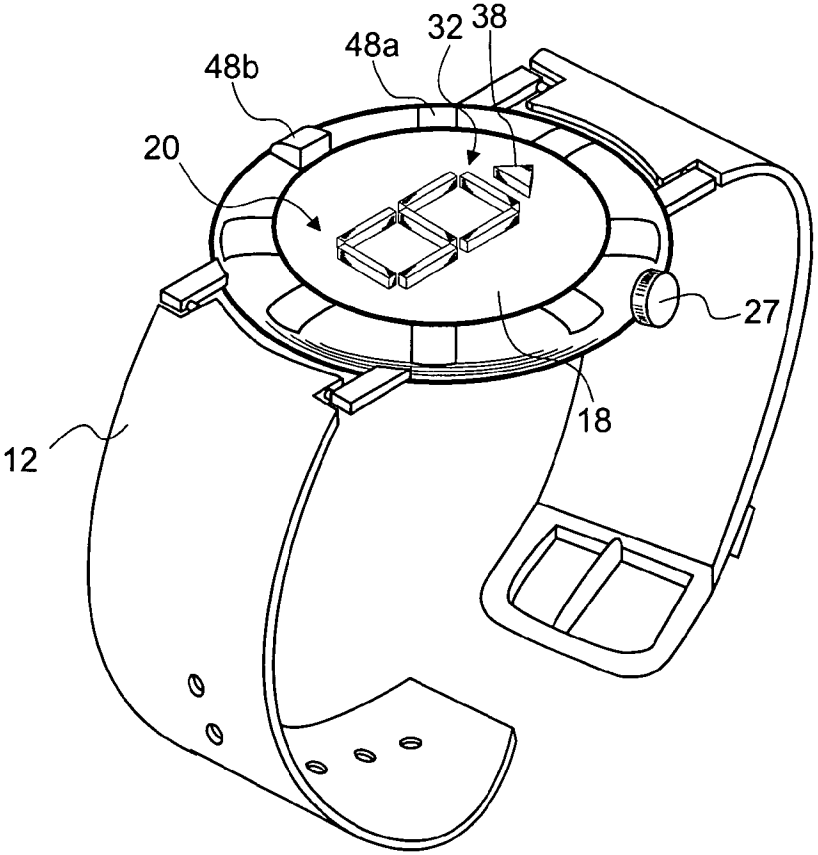
FIGS. 1 and 2 are front and perspective views of a preferred embodiment of a wrist watch constructed according to the invention having a seven-segment tactile display.
Figure 1:
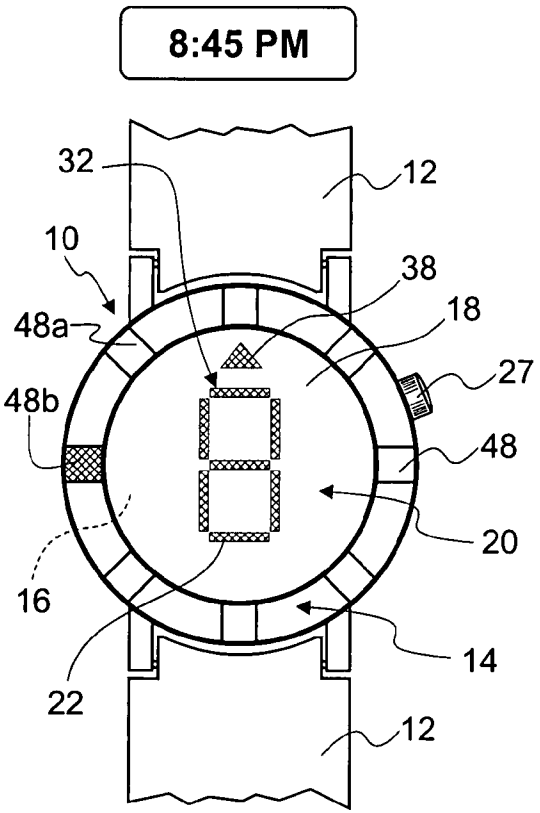
Figure 3:
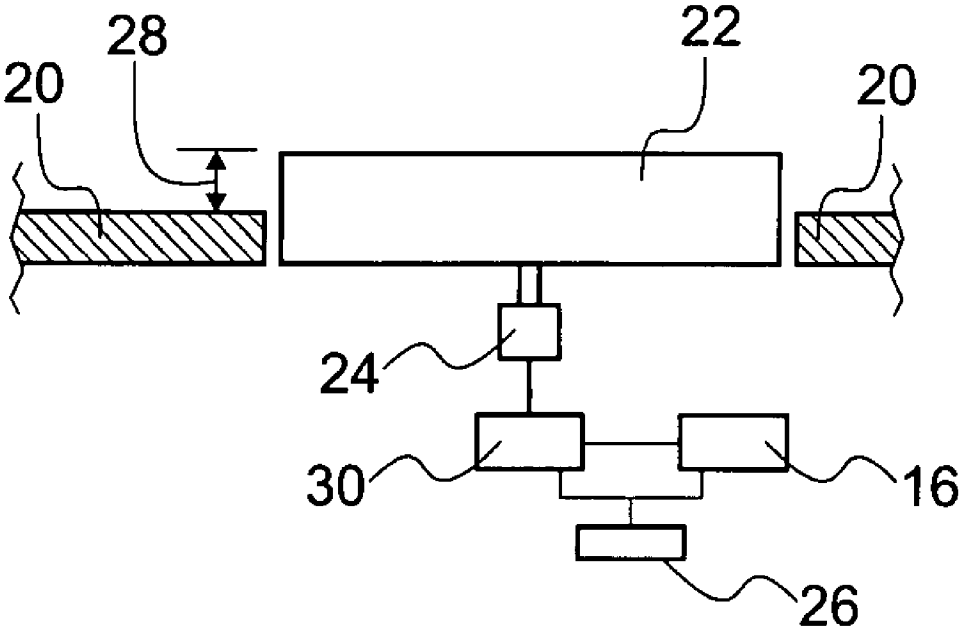
FIG. 3 is a cross-sectional view diagramatically showing the mechanism to operate the moveable portion thereof.

Referring to FIGS. 1–3, a preferred embodiment of the invention is a wristwatch 10 that includes a body 14 to which a wristband 12 is attached. The wristband 12 is configured and dimensioned to mount the body 14 to the wrist of a user.

An internal clock device 16 is preferably disposed within the casing of the body 14, as known in the art, is configured for keeping time. Preferably, the clock device 16 is powered by a power source, such as a battery 26 to keep the time of day. In other embodiments, the clock device is configured as a stopwatch or another type of timer, with appropriate controls being provided for interface by the user. A crown 27 is provided to set the time and operate certain modes of the watch.

The a display 18 is provided, preferably on the watch body 14 face. The display 18 includes a display area 20, in which are disposed a plurality of movable portions 22. The preferred location of the display area 20 is generally centrally on the front face of the body 14 casing, but can alternatively be disposed in other parts of the watch. Actuators 24 are operably associated with the movable portions 22 to move the movable portions 22 with respect to the display area 20 adjacent thereto to a position to produce a tactile sensation when touched by a user. Suitable actuators known in the art include, for example, piezoelectric, solenoid, and mechanical actuators.

The movable portions 22 are preferably moved with respect to the display area 20 by the actuators 24 between inactive and active positions. In the inactive position, the particular movable portion 22 is preferably generally flush with the display area 20, while in the active position, the particular movable portion 22 is readily distinguishable by touch from the display area 20, such by a difference in height or elevation. In the embodiment shown, the movable portions 22 are elevated with respect to the adjacent and surrounding display area 20 in the active position to a height 28 at which they are felt by a user's touch. In the inactive position, the movable portions are retracted sufficiently so that they are easily distinguishable from the movable portions 22 in the active position. Preferably, the movable portions that are in the inactive position are easily distinguishable as being inactive from the movable portions 22 that are in the active position. Most preferably, the movable portions 22 in the inactive position tend to blend in more with the adjacent display area 20, and most preferably are substantially indistinguishable from the display area 20.

The actuators 24 are controlled by a controller 30, which is preferably an electronic controller, but can alternatively be a mechanical system to operate the actuators 24. The controller 30 operatively associates the clock device 16 with the actuators 24 to cause the actuators 24 to move the movable portions 22 depending on the time kept by the clock device 16. Additionally, the actuators preferably are configured to keep the movable portion in the appropriate position to resist pressure applied by a human finger, so that the finger pressure does not change the displayed information that is represented by the combination of movable portions 22 in their respective positions.

The movable portions 22 are configured, disposed with respect to each other, and controller by the controller 30 and actuators 24 to cooperatively form at least one displayed character 32 that is recognizable by touch by a user. The displayed character 32 is sufficiently large that its shape can be tactilely sensed and interpreted by a user. The displayed character 32 is preferably a character that is easily recognizable by a normally sighted person, without learning an additional and substantial code of symbols. For instance, the displayed character is preferably letter or number having the shape that would be used in a visually based numerical or writing system. Preferably, the displayed characters include Arabic numbers or Roman letters. Numbers and letters from other numerical systems or alphabets can be used, or from other character based systems, such as kanji, which are based on reading by sight.

Preferably, the displayed character 32 is not from a system of dots, such as Braille. While the known systems based on protruding dots have been developed and are very useful to the visually impaired, they require a degree of study by normally sighted persons to learn the unfamiliar patterns and combinations of dots. The displayed character 32 in FIGS. 1 and 2 is a number eight, having the shape of the Arabic number eight as would be readily identified by a normally sighted person. A user feels the displayed character 32, and can identify this shape that is familiar as part of a usual, sight based, numbering system, without having to learn a new numbering system.

The movable portions 22 of the embodiment of FIGS. 1–3, the movable portions 22 include elongated segments that cooperatively form the displayed character 32. These elongated segments are preferably arranged as an at least seven-segment display, such as found on traditional visual digital watch displays, with three generally horizontal segments disposed one above the other, and four generally vertical segments disposed two on each side of the group of horizontal segments and with their ends near the ends of the horizontal segments. An eight-segment display can display at least the number characters 0 through 8 and 11, in addition to the letters A, C, E, F, G, H, J, L, P, and U or a blank space, for example, without any confusion with another letter and without substantial differences with the normal appearance of these letters. Other letter and number series can be envisioned, but preferably include at least one character having the shape of a character of a visually based numbering or lettering system. Additional segments can be added to form a greater variety of displayed characters. In FIGS. 1 and 2, by touch, a user can determine that a number 8 is being displayed.

Figure 5:
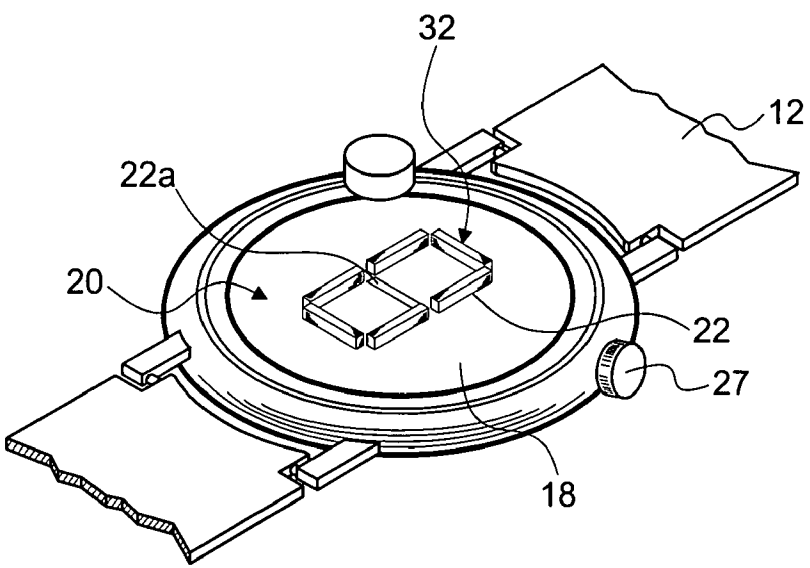
FIGS. 4 and 5 are front and perspective views of another embodiment including a rotational indicator that revolves about the timepiece face.
Figure 4:
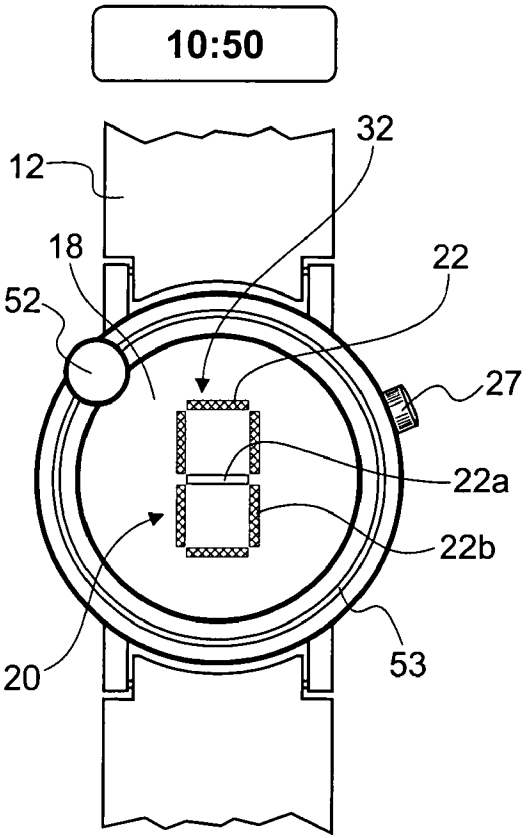

The embodiment of FIGS. 4 and 5 also has movable portions 22 arranged as an eight-segment display. The central horizontal segment 22A is shown in the inactive position, substantially flush with the surrounding display area 20, while movable portions 22B are in the active position, protruding from the surrounding display area 20 and with respect to the inactive movable portions 22A. Thus, by touching the display 18, a user can determine that the displayed character 32 is a 0.

Figure 7:
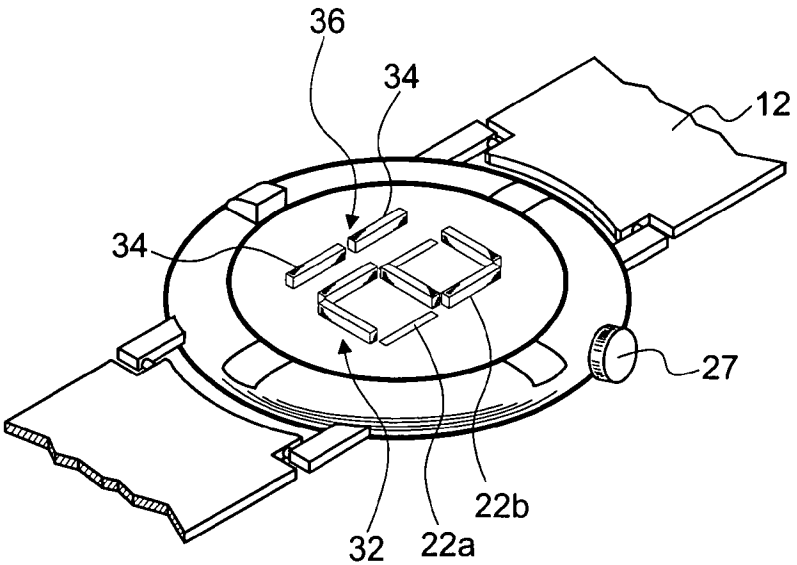
FIGS. 6 and 7 are top and perspective views of an embodiment with a seven-segment display an indicators to show another number.
Figure 6:
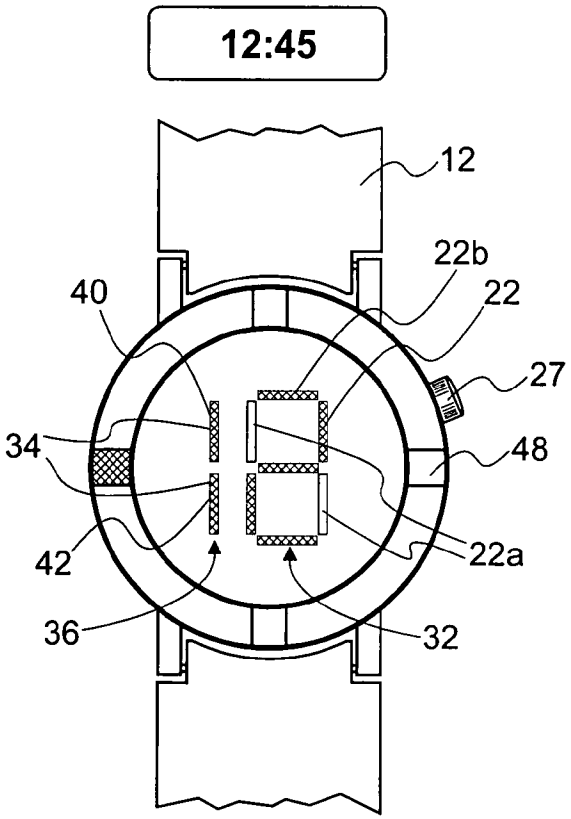

The embodiment of FIGS. 6 and 7 has movable portions 22 that are movable and positionable for displaying the displayed character 32, as well as movable portions 34 for displaying an indicator that preferably further defines the time displayed by the displayed character by the combination of particular character that is displayed with the indicators that are active. The indicator shown in this embodiment is another displayed character 36. Displayed character 32 is a number 2, as five of the movable portions 22B are active and two movable portions 22A are inactive. The movable portions of displayed character 36 are aligned with each other and form a number 1, as they are both active. The two displayed characters 32,36 are sufficiently far apart to be easily distinguishable by the user by touch. Additionally, while a set of two movable portions 34 is used to form the displayed character 36, a single movable portion can be used instead such that the indicator or second displayed character 36 has only two states: active, in which it can be felt, and inactive in which it either blends with the display area 20 or has a different tactile appearance.

This embodiment, is capable of displaying two displayed characters 32,36 simultaneously, and thus can be configured for displaying, for example, the numbers 1 through 12 for a twelve-hour clock. If more movable portions 34 are used for the second displayed character 36 then the numbers 0 through 23 can be displayed for a twenty-four hour clock. In a twenty four-hour clock that uses only two movable portions 34 for the second displayed character, as shown in FIGS. 6 and 7, then the two movable portions can be considered indicators and move independently or together to symbolize a 1 or a 2 or a.m. or p.m., depending on the combination employed. For instance, in a twenty-four hour mode, activating one of the movable portions 34 indicated a 1, and activating both indicates a 2. In a twelve hour mode, the upper movable portion 40 can serve as an indicator for the presence or absence of the number 1, while the lower movable portion 42 can serve and an indicator or a.m. or p.m. by its activation or deactivation.

In this embodiment, all of the characters are displayed in the same portion of the display. Preferably, at least two of the displayed characters are displayed in substantially the same area or overlapping areas, more preferably at least three, five, or seven are displayed in substantially the same or overlapping areas, and most preferably at least nine are displayed in substantially the same or overlapping areas.

The embodiment of FIGS. 4 and 5, on the other hand, displays a single displayed character 32 digit and can represent the hours 1 through 8 and 11. It can also show the tenth hour by displaying a 0 as the displayed character. Another symbol can be used to should the twelfth hour, such as three horizontal lines. The embodiment of FIGS. 1 and 2 have an indicator 38 with at least an active and an inactive position. This indicator 38 can be used, for example, to represent the number 1, as for the hours ten, eleven, and twelve, or to represent an a.m. or p.m. Although symbols are used in these embodiments to represent some or all of the periods of time kept by the clock device 16, most preferably, most of the time periods represented, such as most of the hours, are shown by displaying the character corresponding in common usage to the corresponding time period.

Figure 9:
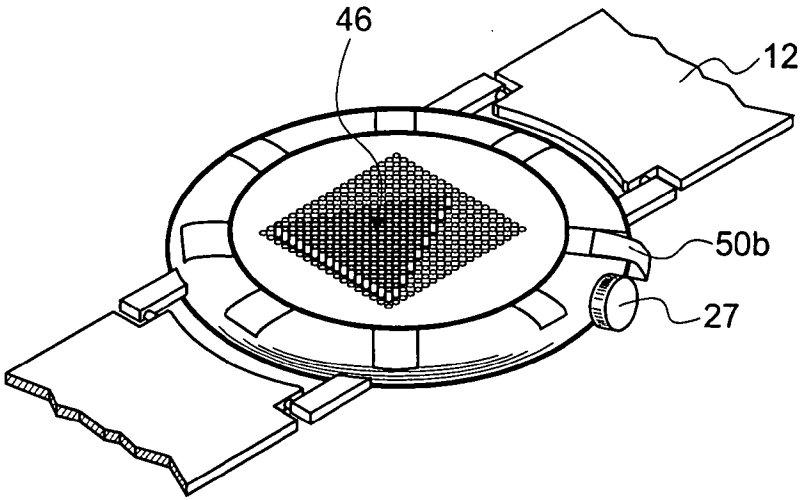
FIGS. 8 and 9 are top and perspective views of an embodiment with multiple movable portions to flexibly show a large variety of displayed characters.
Figure 8:
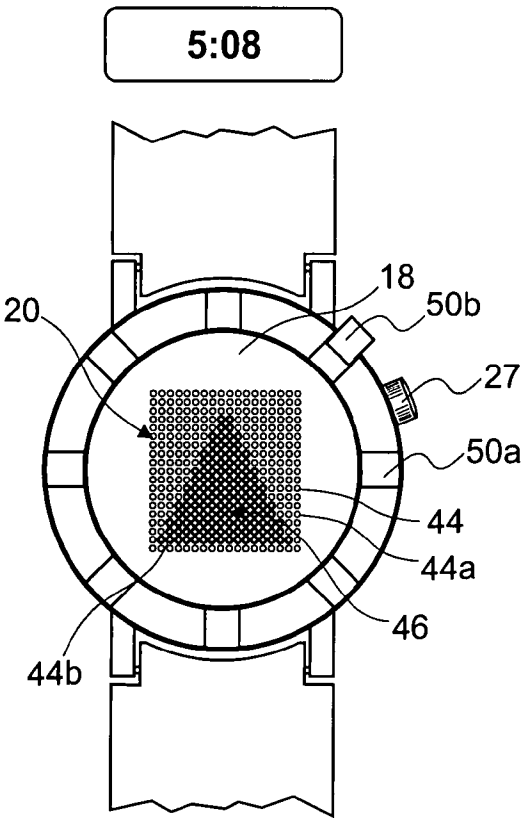

Referring to FIGS. 8 and 9, another embodiment of a display 18 are includes a plurality of movably portions 44 arranged as small pixels that are closely spaced so that by activating preselected pixels, a displayed character can be formed, which a user can sense tactilely. In one embodiment, any spacing between the movable portions 44 small enough to be substantially undetectable by touching with the fleshy part of a human finger without using a finger nail. In other embodiments, the spacing can be larger, but preferably close enough such that the displayed character 46 feels like the shape or alphanumeric number being displayed, rather than widely spaced dots to an average sighted person.

The pixels are shown as having small round cross-sections, but alternatively can have other shapes, such as triangular or irregular sizes, and configured to be able to form the desired shaped character. The displayed character 46 in these figures is a triangle. Other geometric shapes can be displayed, as well as letters, numbers, and other shapes. The displayed character 46 and its shape features are sufficiently large and distinct from the adjacent display area 20, including the inactive movable portions 44A, to be felt and distinguished from at least one other, and preferably all of the remaining characters that can be displayed.

The displayed character 46 in FIGS. 8 and 9 is a triangle. This can be assigned to any time currently kept on the clock device 16. For instance, the triangle can indicate that it is within the five o'clock hour in one embodiment. In another embodiment, geometric shapes can be used to represent 10, 11, and 12 o'clock, or other hours. Preferably, large and easily tactilely identifiable shapes are used, which can include, circles, squares, pentagons, hourglass shapes, etc.

Figure 11:
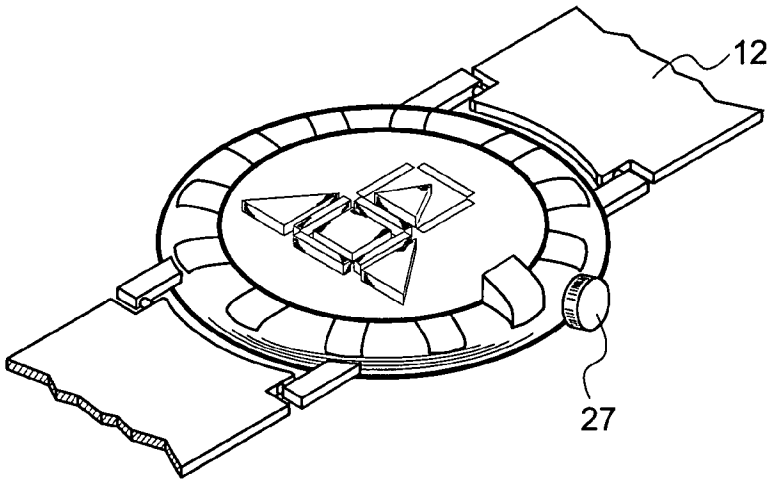
FIGS. 10 and 11 are top and perspective views of another embodiment with a seven-segment display in combination with additional moveable portions to display additional shapes.
Figure 10:
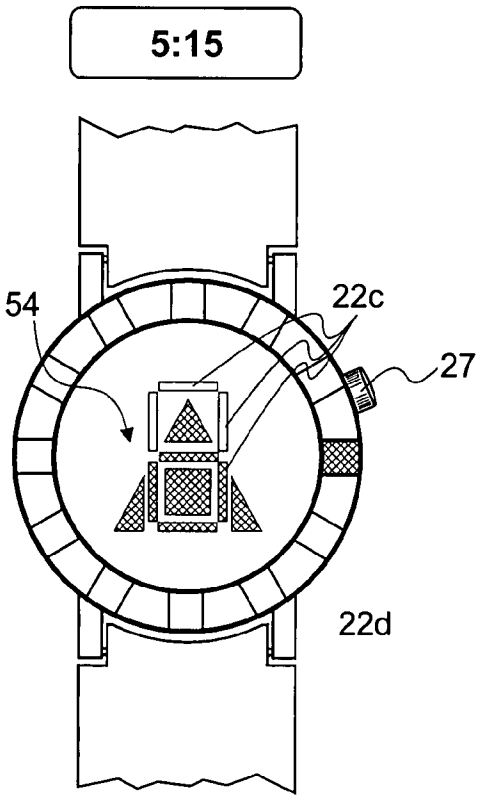

Another manner of showing geometric shapes is employed in the embodiment of FIGS. 10 and 11, which in addition to movable portions 22C forming a seven-segment display, triangular and square filler moving portions 22D are provided to form the triangle as the displayed character 54. Other shapes can be represented with different configurations of movable portions.

The inventive timepiece can be provided with our without indicators for fractions of an hour. The embodiment of FIGS. 1 and 2 has several indicators 48 that are movable by actuators controlled by the controller 30 to indicate fractions of an hour. The fractions indicators 48 are disposed about the circumference of the watch body 14 face and around the display area 20. Other positions for the fractions indicators 48 can alternatively be used. In the embodiment shown, eight fractions indicators 48 are provided, to display eighths of an hour, or 7.5 minute intervals. The fractions indicators are moved axially with respect to the face between inactive and active positions, such that the fractions indicators 48B in the active position can be felt by touch, while the fractions indicators 48A in the inactive positions either blend in with the surrounding adjacent portion of the body 14 or have another position such that a user easily identifies which is/are active. Preferably, only one of the fractions indicators 48 is raised to the active position at any time, but in an alternative embodiment, more than one can be raised to indicate smaller fractions of the hour. The embodiment of FIGS. 6 and 7 has a similar arrangement of fractions indicators 48, but with only four fractions indicators 48, such as to indicate quarter hours. Additional fractions indicators can be provided, such as twelve to indicate five minute intervals. The active fractions indicators 50B in the embodiment of FIGS. 8 and 9 are move radially with respect to the watch body 14 face and display area 20. In other embodiments, the fractions indicators can move in different directions or manners.

Another type of fractions indicator is shown in FIGS. 4 and 5. Fractions indicator 52 is rotated about the face of the watch body 14, preferably at a rate of once per hour along track 53. The position of the fractions indicator 52 can be felt, and tactile markers can be provided to aid in the interpretation of the fraction of the hour that is indicated.

Figure 13:
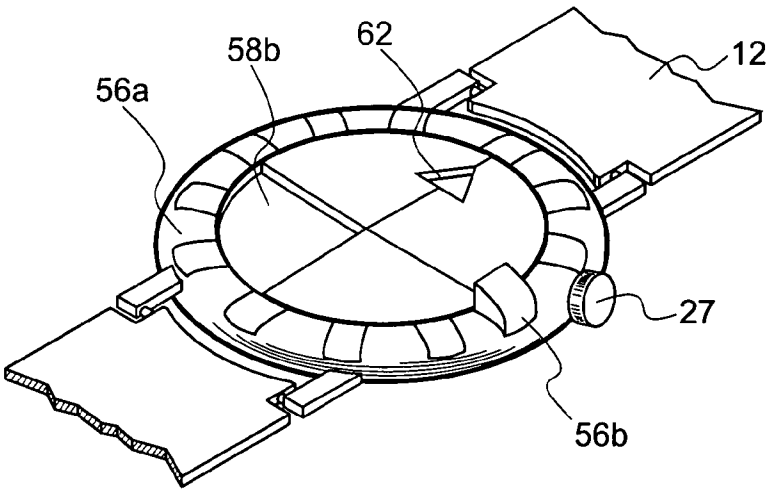
FIGS. 12 and 13 are top and perspective views of an embodiment in which pie-shaped segments display quarter hours.
Figure 12:
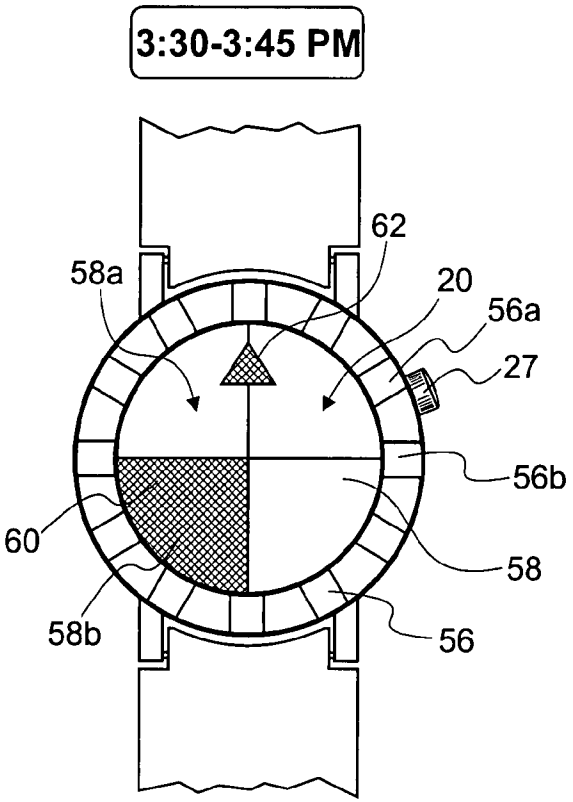

Referring to FIGS. 12 and 13, the indicators 56 can be used to designate the hour kept by the clock device 16 by assuming inactive and active positions at the location around the display are 20 corresponding to the indicated hour. The movable portions 58 in this embodiment show fractions of an hour. In this embodiment, the movable portion 58B in the active position, is positioned recessed from the remaining movable portions 58A, which are in the inactive positions. The displayed characters 60 are pie slices with an orientation and location corresponding each quarter hour, preferably indicate in a digital manner the rough position that would normally be displayed by a minute hand. Another indicator 62 is in an active position, recessed from the surrounding display area 20, which includes the inactive movable portions 58A, to indicate a.m. or p.m.

Figure 14:
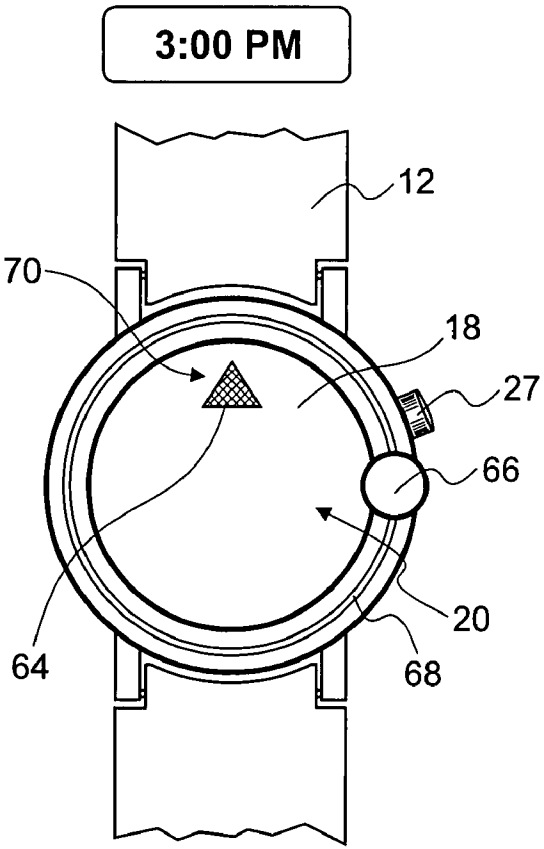
FIG. 14 is a top view of an embodiment with a single moveable portion and an hour indicator that rotates around the display area.

Referring to FIG. 14, hour indicator 66 rotates along track 68 at a rate of preferably once per twelve-hour period. Movable portion 64 moves between active and inactive positions to display a triangle, for instance, as a displayed character 70, which can be used to indicate a.m. or p.m.

While illustrative embodiments of the invention are disclosed herein, it will be appreciated that numerous modifications and other embodiments may be devised by those skilled in the art. For example, while the preferred embodiments have displayed characters that are kept active, such as in a substantially fixed position, substantially throughout the time period they designate, other embodiments provide for activating and deactivations the displayed characters, or cycling through several displayed characters to provide a more complete tactile representation of the time kept by the clock device. Also, the timepiece can be configured as clocks or watches other than a wristwatch, such as a pocket watch or a table clock, although the preferred type of timepiece is small and light enough to be portable on one's person or is a clothes pocket. Therefore, it will be understood that the appended claims are intended to cover all such modifications and embodiments that come within the spirit and scope of the present invention.

What is claimed is:

1. A tactilely readable timepiece, comprising:

a clock device configured for keeping time;

a display comprising:

a display area, at least one movable portion within the display area and movable with respect thereto such that the portion moves from an initial position that is substantially flush with the display to a time-indicating position that is either raised above or depressed below the display area to form at least one displayed character that is recognizable by touch by a user, the displayed character having a tactilely sensible shape that is independent of a system of dots; and an actuator operably associating the clock device to the movable portion for displacing and positioning the movable portion to form the displayed character depending on the current time kept by the clock device.

2. The timepiece of claim 1, wherein the displayed character is alphanumeric or geometrical.

3. The timepiece of claim 1, wherein the movable portion comprises a plurality of movably portions, and the actuator is configured for cooperatively positioning the movable portions for creating the displayed character.

4. The timepiece of claim 3, wherein the actuator is configured for changing the elevation of the movable portions with respect to the display area to form the displayed character.

5. The timepiece of claim 4, wherein the actuator is configured for elevating the movable portions above the display area to form the displayed character.

6. The timepiece of claim 5, wherein the actuator is configured for depressing the movable portion below the display area to form the displayed character.

7. The timepiece of claim 4, wherein the movable portions are generally pie slice shaped and are arranged generally around a central point, such that the height of at least one of the movable portions is changed with respect to the rest to indicate the general analog position corresponding to the time kept on the clock device.

8. The timepiece of claim 3, wherein the displayed character comprises one of different characters representing a preselected time kept by the clock device.

9. The timepiece of claim 3, wherein the displayed character is configured to be identified by a user by the orientation thereof, and has discrete positions in the display area.

10. The timepiece of claim 1, wherein the displayed character is configured to be identified by a user by shape.

11. A tactilely readable timepiece, comprising:

a clock device configured for keeping time;

a display comprising:

a display area, a plurality of movable portions within the display area and movable with respect thereto such that at least some of the portions move from an initial position that is substantially flush with the display to a time-indicating position that is either raised above or depressed below the display area to form at least one displayed character that is recognizable by touch by a user, the displayed character having a tactilely sensible shape that is independent of a coded system of dots, wherein the displayed character comprises at least one of different characters to represent a pre-selected time kept by the clock device, each of the different characters having a shape that is sufficiently large to be determined by touch; and an actuator operably associating the clock device to the movable portions for displacing and positioning the movable portions to form the displayed character as the at least one of the different characters corresponding to the current time kept by the clock device.

12. The timepiece of claim 11, wherein the different characters represent at least each of the hours in a twelve hour period.

13. The timepiece of claim 11, wherein the different characters comprise up to ten different characters.

14. The timepiece of claim 11, wherein the different characters represent at fractions of an hour.

15. The timepiece of claim 11, wherein the movable portions comprise elongated segments that form the displayed character.

16. The timepiece of claim 15, wherein the movable portions are arranged as an at least seven-segment display.

17. The timepiece of claim 11, wherein the different characters comprise Arabic numbers.

18. The timepiece of claim 11, wherein the different numbers comprise geometric shapes that are distinguishable by finger touch.

19. The timepiece of claim 18, wherein the geometric shapes each has less than eight sides.

20. The timepiece of claim 11, wherein at least some of the displayed character is displayed on substantially a same location in the display area.

21. The timepiece of claim 11, wherein the different characters comprise a single digit or shape.

22. The timepiece of claim 11, further comprising an indicator portion that is movable by the actuator between at least two tactilely sensible positions to indicate the time kept on the clock device in combination with the displayed character.

23. The timepiece of claim 22, wherein the indicator comprises a plurality of indicators, each with a position that in combination with the displayed character indicates the time kept on the clock device.

24. The timepiece of claim 23, wherein the plurality of indicators are disposed surrounding the display area.

25. The timepiece of claim 22, wherein the indicator is movable by the actuator along a path to more precisely indicate the time kept on the clock device in combination with the displayed character.

26. The timepiece of claim 11, wherein at least two of the movable portions that form one of the different characters are sufficiently close such that any spacing therebetween is substantially undetectable by touch by a human finger pad.

27. A wristwatch comprising:

the timepiece of claim 11; and a band configured for mounting the timepiece to a user's wrist.

* * * * *